US006209872B1

(12) United States Patent
Caswell

(10) Patent No.: US 6,209,872 B1
(45) Date of Patent: Apr. 3, 2001

(54) METHOD OF PLAYING AN INTERACTIVE BOARD GAME

(76) Inventor: Clement C. Caswell, 6434 Ledge Rd., Thompson, OH (US) 44086

( * ) Notice: Subject to any disclaimer, the term of this patent is extended or adjusted under 35 U.S.C. 154(b) by 0 days.

(21) Appl. No.: 09/198,380

(22) Filed: Nov. 24, 1998

(51) Int. Cl.[7] ..... A63F 3/00
(52) U.S. Cl. ..... 273/244.2; 273/259; 273/277
(58) Field of Search ..... 273/244.2, 244.1, 273/244, 259, 277, 278, 139, 269, 247

(56) References Cited

U.S. PATENT DOCUMENTS 4,019,737 * 4/1977 Witzel ..... 273/277
4,776,593 * 10/1988 DiPersio et al. ..... 273/244.2
4,883,636 * 11/1989 Fantle, Jr. ..... 273/269
4,953,873 * 9/1990 Jacobson ..... 273/274
5,087,051 * 2/1992 LoBue ..... 273/247
5,322,292 6/1994 Dileva et al. ..... 273/244
5,407,204 4/1995 Meyer, III ..... 273/244
5,522,590 6/1996 Moran ..... 273/244.2
5,582,409 12/1996 Mayorga et al. ..... 273/244
5,681,042 10/1997 D'Aurora et al. ..... 273/243
5,713,793 2/1998 Holte ..... 463/5
5,782,470 * 7/1998 Langan ..... 273/139

* cited by examiner

*Primary Examiner*—Benjamin H. Layno
(74) *Attorney, Agent, or Firm*—Forrest L. Collins

(57) ABSTRACT

The present invention permits the period of inactivity in a sporting event, particularly a televised sporting event, to be utilized productively according to the knowledge of the viewer of the a televised sporting event. According to the present invention a game is played during a sporting event utilizing a game board and several sets of cards.

9 Claims, 1 Drawing Sheet

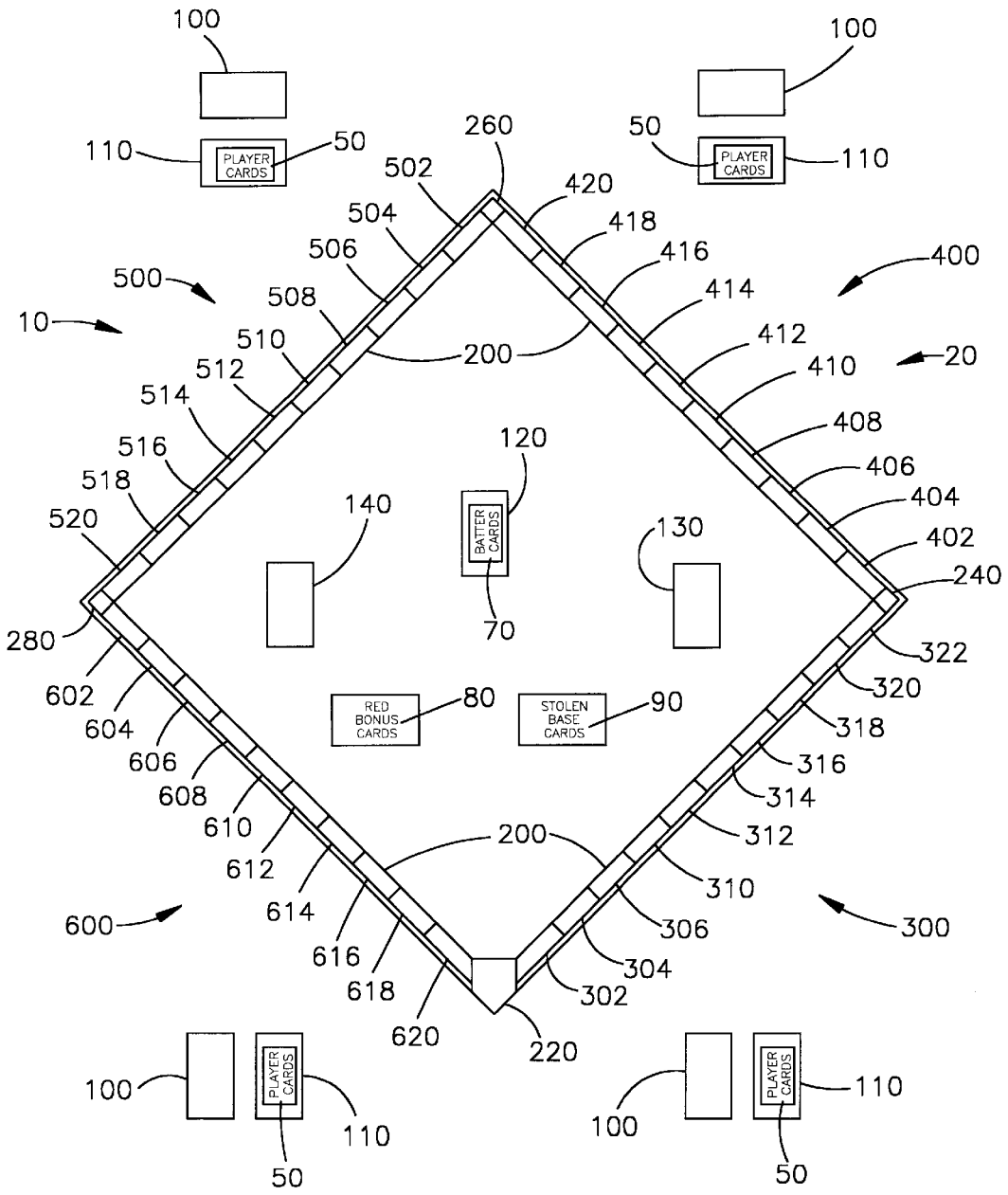
100
100
110
PLAYER CARDS
50
50
PLAYER CARDS
110
260
502
420
504
418
506
416
400
500
508
414
10
510
412
200
20
512
410
514
408
516
120
406
518
404
520
140
BATTER CARDS
130
402
240
70
280
322
602
320
RED BONUS CARDS
80
STOLEN BASE CARDS
90
604
318
606
316
608
314
610
312
200
612
310
600
614
306
300
616
304
618
302
620
220
100
PLAYER CARDS
110
50
100
PLAYER CARDS
110
50

METHOD OF PLAYING AN INTERACTIVE BOARD GAME

BACKGROUND OF THE INVENTION

1. Field of the Invention.

2. The present invention relates to a board game suitable for playing while watching a sporting event. It is known that some sporting events while ultimately exiting, have substantial periods of time of inactivity. The present invention permits the period of inactivity in a sporting event, particularly a televised sporting event, to be utilized productively according to the knowledge of the viewer of the a televised sporting event.

2. Description of the art practices.

U.S. Pat. No. 5,582,409 issued Dec. 10, 1996 to Mayorga et al. describes a baseball board game and more particularly pertains to simulating the sport of playing baseball to aid in the learning of all aspects of the sport of baseball. U.S. Pat. No. 5,407,204 issued to Meyer, III Apr. 18, 1995 describers a board game for simulating the game of baseball in which baseball trading cards are utilized as playing pieces. The game includes a board having a baseball diamond pictured thereon and a plurality of card holders into which baseball trading cards may be positioned. A deck of pitcher cards provides a random pitch to a player at bat, such as a strike, ball, or hit, and a deck of action cards provides a random result of the batter's action, such as a hit, out, or home run. The game pieces are then moved in accordance with the rules of conventional baseball. The game board and the card holders may be provided with illumination for enhancing appearance and facilitating nighttime play.

Dileva et al., in U.S. Pat. No. 5,322,292 issued Jun. 21, 1994 discloses a baseball board game including a plurality of tokens, each of which represent one of the players, a random number generator, a multiplicity of play money, and a game board having a baseball-like playing field and a multiplicity of playing spaces formed on the baseball-like playing field which cooperatively define a continuous closed path in the form of a baseball diamond along which the tokens are moveable in random increments. The multiplicity of spaces includes a starting corner space representing home plate and three additional corner spaces representing first base, second base and third base, respectively, a first group of spaces having monetary gains specified thereon associated with certain baseball-related events in a baseball player's life both on and off the field which have a positive pecuniary effect on a baseball player and a second group of space having monetary penalties specified thereon associated with certain baseball events on and off the field in a baseball player's life which have a negative pecuniary effect on a baseball player.

U.S. Pat. No. 5,713,793 issued Apr. 5, 1996 to Holte describes a commodities options trading game is provided in which the simulated market, which determines whether the value of the simulated commodities options rise or fall, is determined by a real event occurring outside the game being played. In a preferred embodiment, the event from which the simulated market is derived is a real-life sporting event, such as a professional basketball, football, or baseball game. Preferably a host calculator or computer generates the initial option prices and displays the information to a plurality of player stations. After play begins, the host computer updates the options prices using formula based on the current score, time remaining and a other empirically determined factors. The players buy and sell options in response to the momentum of the market. At the conclusion of the sporting event, the options are cashed in for their intrinsic value and the player with the most accumulated wealth is declared the winner.

D'Aurora et al., in U.S. Pat. No. 5,681,042 issued Oct. 28, 1997 discloses a game board apparatus having multiple sets of playing space designators is disclosed. The playing space designators are adapted to be removably affixed to playing spaces of a playing board. Examples of sets would include profession baseball teams, computer and telecommunications firms, professional football teams, etc. When a set of designators is chosen, the players then affix individual designators to playing spaces on the playing board surface. Each playing space designator includes indicia representing one or more characteristics of the playing space designator.

Moran in U.S. Pat. No. 5,522,590 issued Jun. 4, 1996 describes a baseball card game including one deck of cards, the deck including 27 "out" cards, 13 "on base" cards, and 1 wild pitch card, and 9 separate "incidence" cards. Each card discloses a particularly play event, illustrates the symbol identifying same, and describes what action is taken by any base runner who may be on base when the event occurs. The deck is shuffled before each half inning, and the cards are turned-up one at a time until three "out" cards are completed. A plurality of blank box score sheets are included, adaptable to having any preferred line-up of players listed thereon, and the appropriate symbols recorded thereon as the individual cards are turned up.

To the extent that the foregoing patents are relevant to the present invention they are herein incorporated by reference.

SUMMARY OF THE INVENTION

An interactive board game is described comprising:

one or more game pieces, a playing surface (board), for when said game is in use, receiving said game pieces on said playing surface (board), a first set of cards (player), for when said game is in use by one or more participants, having at least one participant select a card from said first set of cards (player), a second set of cards (batter), for when said game is in use by one or more participants, having at least one participant select a card second set of cards (batter), at the participants option, and where said first set of cards (player) corresponds to an independently determined action in a sporting event, and said second set of cards (batter) corresponds to the independently determined action in the sporting event.

The present invention also describes a method of playing an interactive board game comprising moving one or more game pieces about a playing surface (board), said playing surface having a plurality of segments corresponding to an independently determined action in a sporting event, including moving one or more game pieces on said playing surface (board), having at least one participant select a card from a first set of cards (player) where said first set of cards (player) corresponds to an independently determined action in said sporting event, and optionally having at least one participant select a card from a second set of cards (batter), at the participants option, said second set of cards (batter) corresponds to the independently determined action in the sporting event, the participant selecting said first card and optionally said second card prior to the occurrence of the independently determined action in said sporting event based upon the participants belief that the independently determined action in said sporting event will occur, and upon the occurrence of the independently determined action in said sporting event, the participant moving the participants game piece if the independently determined action in said sporting event is correctly predicted in said sporting event according to a value assigned to the first card and the second card if played.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein:

FIG. 1 shows the basic design of an interactive board game.

With more particular reference to the drawings the following is set forth.

DETAILED DESCRIPTION OF THE INVENTION

A interactive board game 10 is shown in FIG. 1. The game board 10 has a playing surface 20. The playing surface 20 of the interactive board game 10 has, for the purpose of exemplification, the general configuration of a baseball diamond.

One or more game pieces 30 (not shown), for when said game is in use, are adaptable for placement and moving about the playing surface 20. A first set of cards 50 (player not shown), for when said game is in use by one or more participants is provided. The second set of cards has a value.

A second set of cards 70 (batter not shown), for when said game is in use by one or more participants is provided. In a preferred embodiment the interactive board game 10 has a third set of cards 80 (Red Bonus not shown). The third set of cards has a value. The value of the third set of cards, have a value which is a multiple of, and used as a substitute for, a card from the second set of card. In a preferred embodiment the interactive board game 10 has a fourth set of cards 90 (Stolen Base).

The playing surface 20 of the interactive board game 10 has a series of card spaces 100. For purpose of exemplification, a first card space 10 is provided for the first set of cards 50. When in use, a participant places one of the cards from the first set of cards 50, on the card space 110.

The playing surface 20 of the interactive board game 10 has a second card space 120 for the second set of cards 70. When in use, a participant places one of the cards from the second set of cards 70, on the card space 110.

The playing surface 20 of the interactive board game 10 has a third card space 130 to discard the second set of cards 70. The playing surface 20 of the interactive board game 10 has a fourth card space 140 for any unused portion of the second set of cards 70.

The playing surface 20 of the interactive board game 10 has a base path 200. At each intersection of the baselines 200 is a base. The bases are home plate 220, first base 240, second base 260, and third base 280.

Located along the base path 200 between home plate 220 and first base 240 are a plurality of segments 300. The segments 300 are generally identified as various occurrences in the sporting event. For instance, in a baseball game the occurrences will be a strike out 302, a home run 304, a fly out 306, a ground out 310, a single 312, and a double 314.

Also located between home plate 220 and first base 240 are segments including a second strike out 316, a second home run 318, a pop out 320, and a walk 322. First base 240 is as a designed segment is a second single.

Located along the base path 200 between first base 240 and second base 260 are a second plurality of segments 400. The segments 400 are generally identified as various occurrences in the sporting event. For instance, in a baseball game the occurrences between first base 240 and second base 260 include a walk 402, a ground out 404, a pop out 406, a home run 408 and a fly out 410.

Also located along the base path 200 between second base 240 and third base 260 are a single 412, a ground out 414, a fly out, 416, a double 418 and a strike out 420. Second base 260 as a designed segment is a ground out.

Located along the base path 200 between second base 260 and third base 280 are a third plurality of segments 500. The segments 500 are generally identified as various occurrences in the sporting event. For instance, in a baseball game the occurrences between second base 260 and third base 280 include a strike out 502, a home run 504, a ground out 506, a double 508, a single 510, and a fly out 512, Also located between second base 260 and third base 280 include a pop out 514, a single 516, a home run 518, and a strike out 520. Third base 280 as a designed segment is a fly out.

Located along the base path 200 between third base 280 and home plate 220 are a fourth plurality of segments 600. The segments 600 are generally identified as various occurrences in the sporting event. For instance, in a baseball game the occurrences between third base 280 and home plate 220 include a strike out 602, a single 604, a pop out 606, a fly out 608, and a home run 610. Also located between third base 280 and home plate 220 are a walk 612, a ground out 614, a home run 616, a double 618 and a strike out 620. Home plate 220 is designated as a ground out.

While the method of playing the game is baseball it could be any sport which allow the participants sufficient time to make decisions on the course of action to take given a specific situation. Thus any of several sports including American football may be the subject of the interactive board game 10.

The interactive board game 10 is played while watching a sporting event over which the participant has no control other than the participant's knowledge of the sport, the likely choice of action of the coach, and the participant's knowledge of the sporting event player's ability which results in the independently determined action of the sporting event.

The interactive board game 10 equipment comprises 10 batter cards 70, 1 special red bonus card 80, 1 special blue stolen base card 90, one set of 9 player cards 50, the board and an appropriate number of game pieces 30, i.e. one for each participant.

The interactive board game, as applied to baseball begins before the underlying sporting event. Each participant is randomly dealt 10 cards 70 (Batter) from a shuffled deck of the cards 70 (Batter). Typically, the deck of cards 70 (Batter) will have 60 cards corresponding to the segment 300, segment 400, segment 500 and segment 600. Each participant is also given 1 card 80 (bonus card) and 1 card 90 (Stolen Base Card).

The object of the interactive board game 10 is to be the first participant to score and win the game by going around the segments to first base 240, second base 260, and third base 280, and ultimately reaching home plate 220, Play of the interactive board game 10 commences with the participant(s) placing one of the 9 player cards 50 in play in front of the participant(s). Each participant(s) may also set one of the participant(s) batter cards 70 in the in play in front of the participant(s). The selection of the player cards 50 and the batter cards 70 each participant attempts to move off home plate 220 toward first base 240 by "predicting" or "guessing" what each batter will do (the independently determined action of the sporting event).

If the participant correctly determines what the batter does (the independently determined action of the sporting event) the participant moves the participant's game piece 30 according to the value assigned to the player cards 50 and the batter cards 70 along the segments 300, If the participant correctly determines what the batter does (the independently determined action of the sporting event) the batter card 70 is retained, if not the batter card 70 is surrendered and is out of play for the rest of the game. The player card 50 is retained by the participant for the entire game regardless of whether the independently determined action of the sporting event is correctly predicted.

As an example of scoring for example, a participant may play the batter 70 as a single by putting the participant's player card bearing the designation single in play. If the batter in the sporting event singles, that participant moves ahead 1 space. If the same participant had also played a batter card 70 bearing the designation single that participant would be entitled to additional 2 spaces.

As an additional feature of the invention, when a participant's game piece 30 lands on certain of segments 300, segments 400, segments 500, or segments 600 including, but not limited to first base 240, second base 260, third base 280 that participant is entitled to pick up one batter card 70 from the remaining batter cards 70 in the pile.

As an additional feature of the invention, when a participant's game piece 30 is one on of the one of the segments 300, segments 400, segments 500, or segments 600, for example ground out 310, and the participant moves ahead one segment to single 312 regardless of whether the player card 50 and the batter card 70 are correctly played if the player card 50 and the batter card 70 are correctly played then the corrects situation results in the moving of the game piece 30 as previously described.

All player cards 50 are worth one space except double cards and home run cards, which are each worth two spaces, and triple cards which is worth 3 spaces. Batter cards 70 values are double the value of the corresponding player cards 50. For example, if a participant is on a segment marked home run (value=2 segments), the participant plays a home run player card 50 (value=2 segments), and the participant also plays a home run batter card 70 (value=4 segments) and the batter hits a home run, that participant would move ahead a total of 8 segments. A fly out is a fly ball caught by an outfielder. A pop out is any ball caught by an infielder. A hit batter is a walk. If an error is made the play is what should have happened. In other words, if an outfielder drops a fly ball and it is declared an error, it is counted as a fly out.

A stolen base card 90 can be used in place of a batter card and is worth 3 spaces. As soon as the runner steals, is caught stealing or the batters at bat is over, the blue stolen base card 90 is retired for that game, while a white stolen base card 90 is put in the discard pile, regardless of the outcome.

The bonus cards 80 may be used in place of a batter card 70 and are worth two value segments, except when used on first base 240, second base 260, third base 280 in which case they are worth four segments. A bonus card 80, regardless of what the batter does, moves your player ahead two or four segments. As with the stolen base cards 90, the red bonus cards 80 are, once used, retired for the game, while the white bonus cards 80 are put in the discard pile.

The game can be started or ended at any point of the real baseball game. Suggestions for a shorter game are for three or six innings, with who ever being furthest along the board declared the winner. The first participant to reach or cross home plate is the winner. If no participant reaches home by the time the game is over, the participant furthest around the board is the winner. If more than one participant reaches or crosses home at the same time, the person with the most batter cards 70 left wins. Otherwise, the game is a tie.

By way of strategy a participant should try to use the batter cards 70 sparingly, as you can run out of them fairly quickly. If the participant plays the cards right you could have a few batter cards 70 to play near the end to finish strong. The participant is wise to use a bonus card 80 to get started and/or save the bonus card 80 for those bases, where they are worth double.

What is claimed is:

1. A method of playing an interactive board game comprising: moving one or more game pieces about a playing surface, said playing surface having a plurality of segments corresponding to an independently determined action in a sporting event, including moving one or more game pieces on said playing surface, having at least one participant select a card from a first set of cards where said first set of cards corresponds to an independently determined action in said sporting event, and optionally having at least one participant select a card from a second set of cards, at the participants option, said second set of cards corresponds to the independently determined action in the sporting event, the participant selecting said first card and optionally said second card prior to the occurrence of the independently determined action in said sporting event based upon the participants belief that the independently determined action in said sporting event will occur, and upon the occurrence of the independently determined action in said sporting event, the participant moving the participants game piece if the independently determined action in said sporting event is correctly predicted in said sporting event according to a value assigned to the first card and the second card if played.

2. The method of playing the interactive board game according to claim 1, wherein said second set of cards has a value, further comprising providing a third set of cards, each card having a value which is a multiple of, and used as a substitute for, a card from said second set of cards, and each card from said third set of cards for permitting the participant playing said card to move said game piece according to the value of said third card notwithstanding correctly predicting the independently determined action in said sporting event.

3. The method of playing the interactive board game according to claim 1, wherein said second set of cards has a value, further comprising a fourth set of cards, having a value which is a multiple of and used as a substitute for, a card from said second set of cards.

4. The method of playing the interactive board game according to claim 3 wherein the first set of cards is retained by the participant throughout the game.

5. The method of playing the interactive board game according to claim 1 wherein the first set of cards is retained by the participant throughout the game.

6. The method of playing the interactive board game according to claim 1 wherein second set of cards is retained by the participant only if the participant correctly predicts said independently determined action in said sporting event, and is surrendered if the participant incorrectly predicts said independently determined action in said sporting event.

7. The method of playing the interactive board game according to claim 1 wherein the sporting event which determines the independently determined action is baseball.

8. The method of playing the interactive board game according to claim 1 wherein the sporting event which determines the independently determined action is American football.

9. The method of playing the interactive board game according to claim 1 wherein upon a participant moving a game piece to a selected segment on the plurality of segments on said playing surface, draws an extra card from a second set of cards.

* * * * *